US006989760B2

(12) United States Patent
Dierking et al.

(10) Patent No.: US 6,989,760 B2
(45) Date of Patent: Jan. 24, 2006

(54) GARAGE DOOR REMOTE MONITORING AND ACTUATING SYSTEM

(76) Inventors: Todd R. Dierking, 928 Maroon Peak Cir., Superior, CO (US) 80027; William W. Dierking, 25823 Bristlecone Ct., Golden, CO (US) 80401

( * ) Notice: Subject to any disclaimer, the term of this patent is extended or adjusted under 35 U.S.C. 154(b) by 151 days.

(21) Appl. No.: 10/770,745

(22) Filed: Feb. 3, 2004

(65) Prior Publication Data

US 2005/0174250 A1 Aug. 11, 2005

(51) Int. Cl.
*G08B 21/00* (2006.01)

(52) U.S. Cl. ..... 340/686.1; 340/539.1; 340/539.11; 340/539.14; 340/5.7; 340/5.71

(58) Field of Classification Search ..... 340/686.1, 340/539.1, 539.11, 539.14, 5.2, 5.7, 5.71
See application file for complete search history.

(56) References Cited

U.S. PATENT DOCUMENTS

| | | | | |
|---|---|---|---|---|
| 3,786,502 A | | 1/1974 | Stendig | |
| 4,463,292 A | | 7/1984 | Engelmann | |
| 5,510,686 A | | 4/1996 | Collier | |
| 5,689,236 A | | 11/1997 | Kister | |
| 5,698,073 A | * | 12/1997 | Vincenzi | 160/188 |
| 5,752,343 A | * | 5/1998 | Quintus | 49/29 |
| 5,781,107 A | | 7/1998 | Ji | |
| 5,864,134 A | | 1/1999 | Burgess | |
| 5,883,579 A | | 3/1999 | Schreiner | |
| 5,969,637 A | * | 10/1999 | Doppelt et al. | 340/825.69 |
| 5,990,828 A | * | 11/1999 | King | 342/359 |
| 6,011,468 A | | 1/2000 | Lee | |
| 6,049,285 A | | 4/2000 | Mangal | |
| 6,166,634 A | | 12/2000 | Dean | |
| 6,184,787 B1 | | 2/2001 | Morris | |
| 6,184,800 B1 | | 2/2001 | Lewis | |
| 6,191,706 B1 | | 2/2001 | Kositkun | |
| 6,218,962 B1 | | 4/2001 | Fiene | |
| 6,310,548 B1 | | 10/2001 | Stephens et al. | |
| 6,374,543 B1 | * | 4/2002 | Bishai | 49/199 |
| 6,469,464 B1 | | 10/2002 | McCall | |
| 6,522,258 B1 | | 2/2003 | Lott | |
| 6,531,966 B2 | | 3/2003 | Krieger | |
| 6,563,278 B2 | | 5/2003 | Roman | |
| 6,563,431 B1 | | 5/2003 | Miller | |
| 6,587,739 B1 | | 7/2003 | Abrams et al. | |
| 6,597,291 B2 | | 7/2003 | Tsui | |
| 2002/0180600 A1 | | 12/2002 | Kirkland et al. | |

* cited by examiner

*Primary Examiner*—Daryl C Pope
(74) *Attorney, Agent, or Firm*—Leyendecker and Lemire, LLC; Kurt Leyendecker

(57) ABSTRACT

A system typically comprising a garage module that is coupled with a garage door opener and a remote module is disclosed. The remote module and the garage module are coupled for communication therebetween through an AC power grid of an associated building. The remote module includes an indicator that informs the user whether or not an associated garage door has been left open and permits the user to close the garage door using the remote module. Optionally, the system includes accessory modules typically for turning on one or more lamps when the garage door is opened so that a user can enter a lit home and need not fumble to find a light switch. Additionally, the garage module includes laser pointer that activate when a user opens a garage door and provide a convenient visual indicator to assist the user in parking his/her vehicle in a desired location.

20 Claims, 5 Drawing Sheets

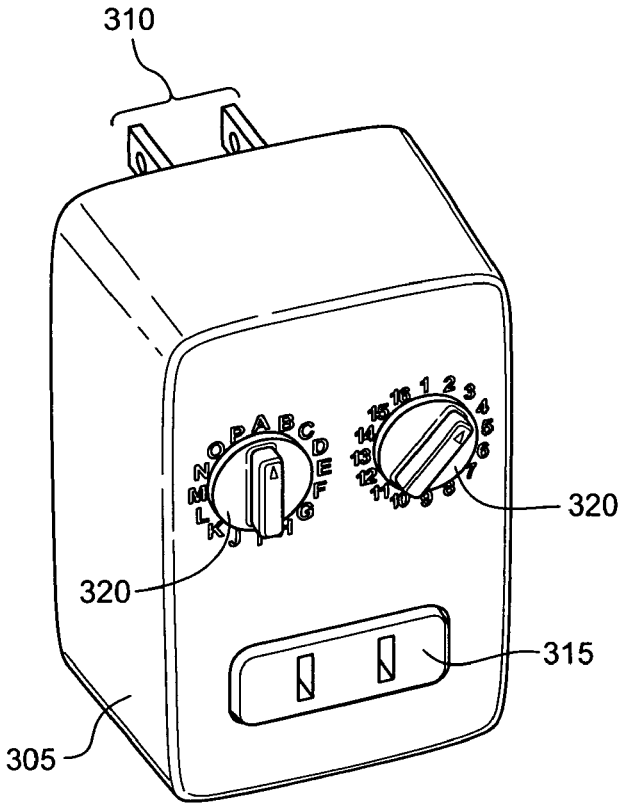
FIG. 4
FIG. 5
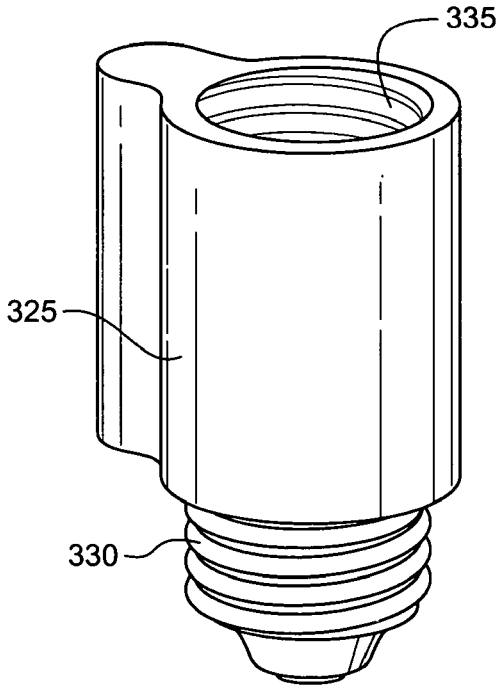

GARAGE DOOR REMOTE MONITORING AND ACTUATING SYSTEM

FIELD OF THE INVENTION

The invention relates generally to automatic garage door openers, and more particularly to a system for indicating whether a garage door is open and for activating the garage door opener from a remote location to close or open the door.

BACKGROUND

Automatic garage door opening systems have become very popular in the past twenty years such that residences wherein a person has to manually open and close the garage door are the rare exception. The typical garage door opener system comprises an electric motor unit mechanically coupled to the garage door through an associated track mechanism, a wireless receiver electrically connected to an actuation switch circuit of the motor unit, one or more actuators mounted at convenient locations in the garage for opening and closing the garage door, and a wireless remote control device typically kept in a vehicle for opening and closing the garage door from within the vehicle. Almost universally, garage door opener systems also include a safety sensor that prevents the garage door from closing if a person or any object is in the path of the closing door. This safety feature prevents the garage door from injuring a child or a pet that might be in the door's path, and it also prevents the garage door from damaging inanimate objects, such as a vehicle that has not been fully pulled into the garage.

Unfortunately, typical garage door opener systems have no way of alerting a user if the garage door has been left open unintentionally. Many users routinely push an actuator next to the door into their residence to close the garage door as they enter their residence. Commonly, the user does not wait to see if the door completely closes. Accordingly, if an object such as a child's toy is located in the path of the door, or the safety sensor is misaligned, the door with will not close and will automatically return to its fully open position. Additionally, many garage door opener users will for whatever reason just leave the garage door open and forget to close it before they retire for the evening.

Many people keep valuable items in their garages such as power tools and bicycles that can be easily taken from the garage by nefarious individuals who pass by an open and tempting garage during the night when most if not all of the applicable residence's occupants and the occupants of neighboring residences are asleep. It is not uncommon for a homeowner to have something of value taken from their garages at some point in their lives because they mistakenly left the garage door open.

Various remote monitoring systems are known that indicate to a person located in a remote location from the garage door, such as in a bedroom of the associated residence, whether or not the garage door is open. Examples of such systems are described in the following U.S. Pat. Nos. 6,597,291; 6,522,258; 6,184,787; 6,049,285; 6,166,634, 5,883,579; and 5,689,236. While the specifics of these systems vary, none of them provide any mechanism for closing the door from the remote location. Rather, the person noticing the signal from the device that the garage door is open has to get up, walk over to the garage door, and activate the garage door opener to close the garage door. This can be an inconvenience, especially when the room the person is coming from is on a second floor.

Other systems are known that automatically close an open garage door without input of a person after the satisfaction of specific criteria. U.S. Pat. Nos. 4,463,292, 5,510,686, 5,752,343, 6,469,464, and 6,563,278 all teach systems that automatically closes a garage door after a set time interval. U.S. Pat. No. 5,752,343 also teaches a device that will close the door when it becomes dark. Unfortunately, if there is something blocking the door, the door will not shut and a person will have no idea the door was not in fact closed. Additionally, these devices have the potential to lock the owner out of their home if the door automatically closes while they are outside.

SUMMARY

According to one embodiment of the invention, a garage door status monitoring and actuating system comprises a first garage module adapted to be coupled to a first garage door opener and to actuate the first garage door opener. The garage module includes a first transceiver. The system also includes (i) a first garage door position sensor adapted for being coupled with the first garage module, and (ii) a first remote module adapted to be located remotely from the first garage module within a building. The first remote module includes a second transceiver, a first indicator, and a first switch. Operationally, the first transceiver is adapted to send a first signal to the second transceiver when the garage door position sensor is in a first state. The first remote module is adapted to activate the first indicator upon receipt of the first signal. The second transceiver is adapted to send a second signal when the first switch is activated, and the first garage module is adapted to actuate the garage door opener upon receipt of the second signal. According to another embodiment of the invention, a garage door status monitoring and actuating system comprises a garage module that is electrically coupled with a garage door opener and an AC power grid of an associated building. The garage module includes a first transceiver adapted to transmit at least a first signal over the power grid and receive a second signal over the power grid. The garage module also includes a garage door position sensor that is mounted proximate a garage door. The garage door position sensor is coupled with the garage door module, the garage door position sensor has at least two states, a first state when the garage door is at least partially open and a second state when the garage door is completely closed. The system further includes a remote module electrically coupled with the AC power grid of the associated building. The remote module includes (i) a second transceiver adapted to transmit at least the second signal over the power grid and receive the first signal, (ii) a user actuatable switch, and (iii) a visual indicator. Operationally, the first signal is transmitted by the garage module when the garage position sensor moves into the first state. The remote module, upon receiving the first signal, activates the visual indicator to indicate the garage door is open. The remote module transmits the second signal when the switch is depressed, and the garage module, upon receiving the second signal, activates the garage door opener to close the garage door.

According to yet another embodiment of the invention a method of operating a garage door status monitoring and actuating system is described. The method comprises in the provided order: (i) sending a first signal over an associated building's power grid from a garage module to a remote module; (ii) activating a visual indicator at the remote module indicating an associated garage door is open; (iii) sending a second signal over the associated building's power grid from the remote module to the garage module upon activating a switch on the remote module by the user; and (iv) activating the garage door opener to close the garage door after receiving the second signal.

BRIEF DESCRIPTION OF THE DRAWINGS

FIG. 4 is an isometric view of a plug-in accessory module according to one embodiment of the present invention.

FIG. 5 is an isometric view of a screw in accessory module according to one embodiment of the present invention.

DETAILED DESCRIPTION

An Overview

Figure 1:
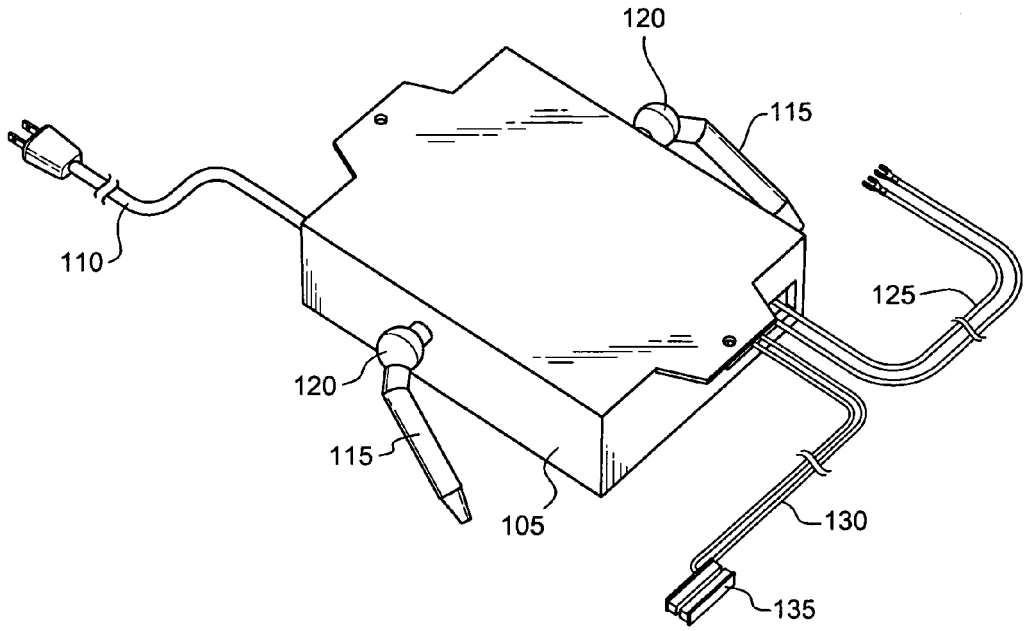
FIG. 1 is an isometric view of a garage module according to one embodiment of the present invention.

A system for remotely monitoring whether a garage door is open and for remotely closing the garage door from the monitoring location is described. The system typically includes a garage module that is connected to a garage door opener, and one or more remote modules that indicate usually via an LED whether the garage door is open and include a switch that can be activated by a user to activate the garage door opener by way of the garage module and close the garage door. Accordingly, a user having a remote module located for instance in his/her bedroom does not need to leave the bedroom to close the garage door before retiring for the evening.

In a preferred embodiment, the system is flexible permitting multiple remote modules to be located in various locations around a building or residence wherein a user can close the garage door from any one of the remote modules. Furthermore, the remote modules are not hard wired to the garage unit and accordingly can be moved from one location to another with ease without the need to reconfigure the remote module or rewire a connection between the remote module and the garage module.

In a variation of the preferred embodiment, both the garage module and the remote module(s) plug into the AC power grid of the associated building to both provide power to the modules and to provide a path for transmission and reception of signals relayed between the garage and remote modules. Advantageously, by plugging the remote unit into any outlet within a particular building, the remote module can establish communication with the garage module. Also because a wireless transmission means is not utilized in the preferred variation, it will not interfere or be interfered with by other wireless devices being utilized in a building, such as cordless telephones, wireless networks, and certain remote control devices. However, in certain variations of the preferred embodiment, modules including wireless transceivers can be utilized in place of the power grid transceivers.

One signal transmission protocol utilized in preferred variations of the preferred embodiment is X-10. The X-10 protocol is described in "Digital X-10" by Phillip Kingery, which is included as Appendix A, fully incorporated by reference, and can also be found on the World Wide Web at http://www.hometoys.com/htinews/feb99/articles/kingery/kingery13.htm. By using the X-10 protocol, other X-10 compatible modules can be incorporated to provide added functionality to the system. For instance, an accessory module can be provided wherein the garage module can signal the accessory module to turn on a light in the building when the garage door is opened. Further, the garage module configured to signal the light to turn off after a predetermined period of time has passed. As many accessory modules as desired can be incorporated into the system such that the act of opening a garage door can cause many if not all of the lamps in a building to turn on. It is to be appreciated, however, that alternative variations of the preferred embodiment can use a power grid signal transmission protocol that is different from the X-10 protocol but effectively accomplish a similar result.

In other variations of the preferred embodiment, one or more laser pointers are provided with the garage module. The pointers can be positioned to point to a specific spot on an associated properly parked vehicle. Typically, the pointer(s) illuminate when the garage door is opened for a preset period of time. Accordingly, a user in the vehicle can maneuver the vehicle as he/she pulls it into the garage such that the point of light coincides with the specific spot on the vehicle to indicate the vehicle is properly parked.

Terminology

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases means that a particular feature, structure, or characteristic described in connection with the embodiment is included in at least an embodiment of the invention. The appearances of the phrase "in one embodiment" in various places in the specification are not necessarily all referring to the same embodiment.

The term "couple" or "coupled" as used in this specification and the appended claims refers to either an indirect or direct connection between the identified elements or objects. Often the manner of the coupling will be related specifically to the manner in which the two coupled elements interact. For example, two elements are electrically coupled if electrical current can travel from one element to another even if the elements are not directly connected to one another but rather by way of a wire or other electrically conductive trace. Further, two elements can be operatively coupled if they are in communication with each other. For example, a wireless sensor can be operatively coupled to a wireless receiving device if signals are sent form the sensor to the receiving device for use by the receiving device.

The term "switch" as used in this specification and the appended claims refers to any device for directly or indirectly opening or closing a conductive electrical path including but not limited to rotary switches, slide switches, rocker switches, touch sensitive switches, toggle switches, push buttons, pressure switches, and sensor switches.

The term "state" as used in this specification and the appended claims refers a condition of an associated object whether physical or otherwise. For instance, a switch in a first state can be in the "off" position and in the "on" position in a second state. Alternatively, a semiconductor device can be in a first state when it is conductive and a second state when it is nonconductive even through the physical condition of the device is unchanged (at least on a non-atomic level).

One First Preferred Embodiment

Referring to FIGS. 1–5, the various components of a preferred embodiment of the garage door monitoring and garage door closing system are illustrated. The typical system includes: (i) a garage module 100 as best illustrated in FIG. 1; (ii) at least one remote module 200; and (iii) an optional accessory module 300.

Figure 2:
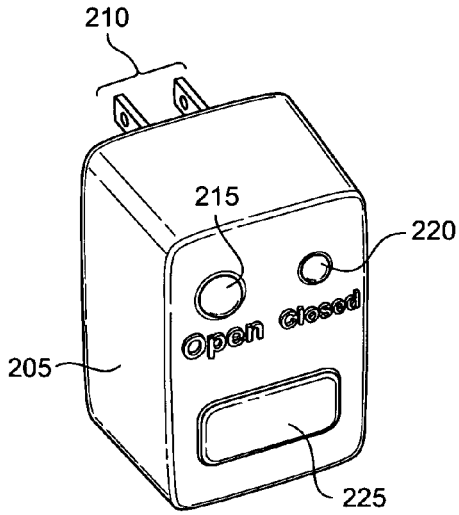
FIG. 2 is an isometric view of a plug-in remote module according to one embodiment of the present invention.
Figure 7:
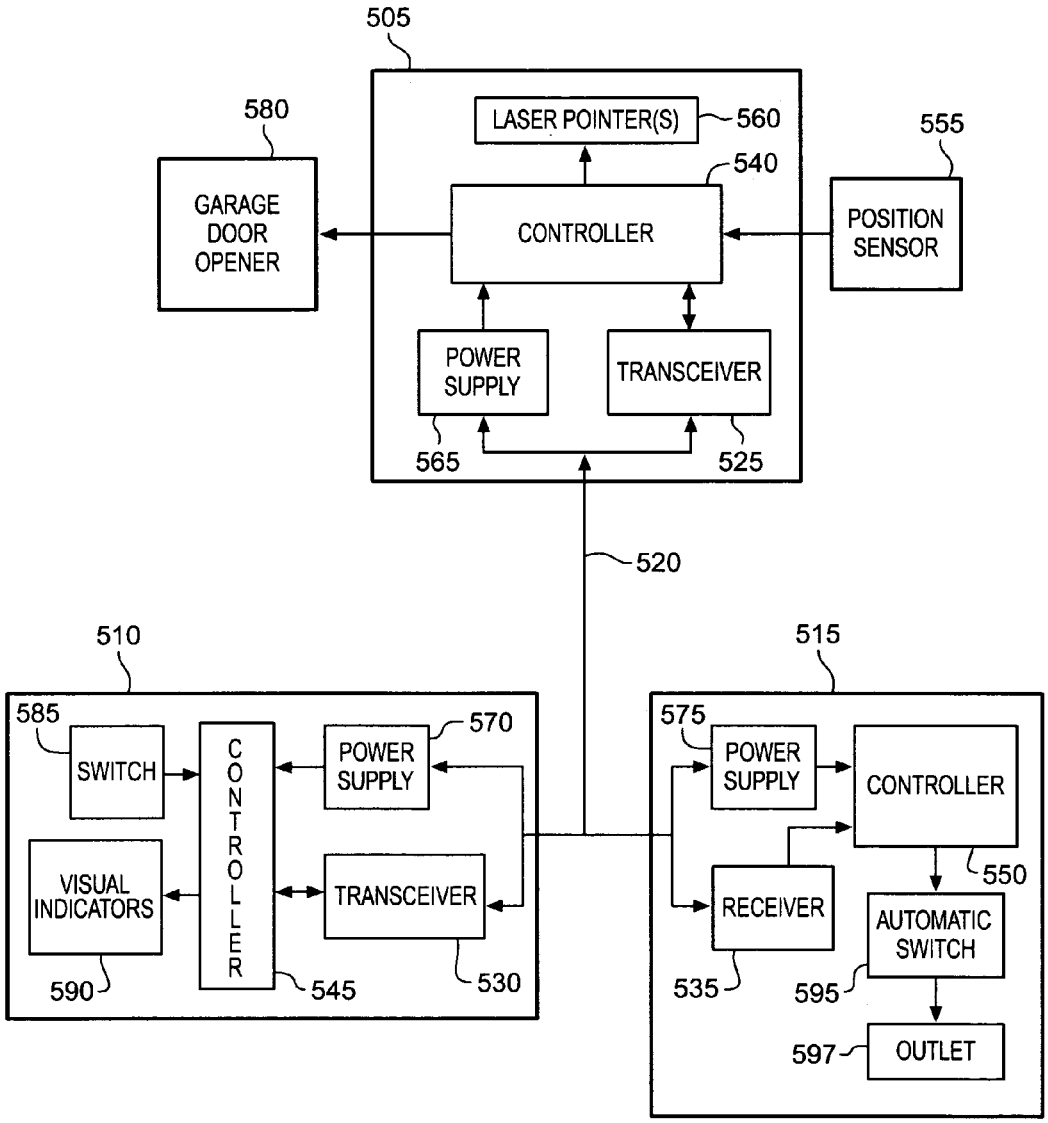
FIG. 7 is a block diagram illustrating the various modules of one embodiment of the present invention.

Referring to FIG. 1, the garage module comprises a housing 105 containing a power supply, a controller, and a power grid transceiver (see FIG. 7). Typically, the housing is either metal or plastic although the particular material is not considered particularly important so long as it can protect the electronic circuitry contained therein. An AC power cord 110 with a standard two or three prong plug extends from the housing. The cord serves to both supply power to the module, as well as, provide a connection with the building's power grid for the transmission and receipt of signals. Extending from the right and left sides of garage module are laser pointers 115 that are mounted to the housing via ball and socket or other flexible joints 120 to permit the pointers to be aimed to point at a desired spot. The pointers are electrically coupled to the controller and help guide a driver of a vehicle pulling into an associated garage to properly position the vehicle within the garage. Two pair of wires 125 and 130 extend from the front side of the module. The first pair of wires typically includes bare wire or spade connector ends to connect to the garage door opener. The second pair of wires are coupled with a position sensor 135, such as a magnetic switch, that indicates whether the associated garage door is open or closed. In alternative embodiments a terminal strip can be provided in place if the two pairs of wires extending from the garage module. Referring to FIG. 2, a typical remote module comprises a housing 205 typically made of a plastic or metallic material. In a preferred form, the remote module is a self-contained wall unit that simply plugs into an open AC receptacle by way of AC outlet prongs 210 that extend from the backside of the module. Advantageously, a user can quickly and easily move the remote module from room to room without difficulty. Contained inside the housing are a power supply, a remote module controller, and a power grid transceiver (see FIG. 7). Both the power supply and the transceiver are coupled to the AC outlet prongs so that the power grid of the building can be used to send and receive signals from the garage module, as well as, provide power to the module. On the front side of the housing, a visual indicator 215 typically in the form of a LED or other type of lamp is provided to indicate whether an associated garage door is open. A second visual indicator 220 may also be provided to indicate that the door is closed. Typically, the LED of the second indicator will be of a different color than the LED of the first visual indicator 215 and may be smaller as well so that a user quickly glancing at the remote module is unlikely to confuse the meaning of either visual indicator. Finally, a switch 225, typically in the form of a push button, is provided for initiating the remote module to send a signal to the garage model to activate the garage door opener and close the associated garage door.

Figure 3:
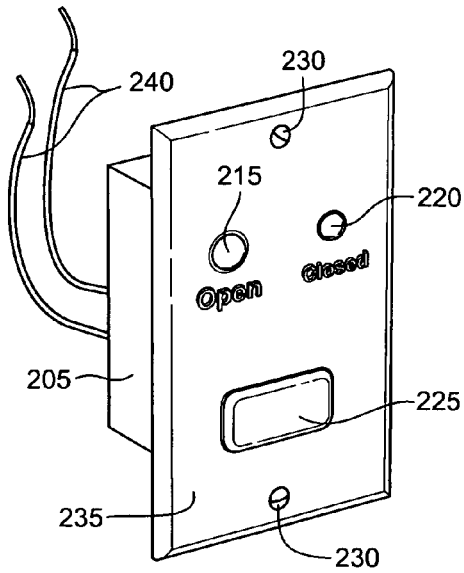
FIG. 3 is an isometric view of a hardwired remote module according to one embodiment of the present invention.

In addition to the plug-in remote module illustrated in FIG. 2, a hard-wired remote module can be utilized as illustrated in FIG. 3. A typical hard-wired module is designed to attach to a typical household switch box via a pair of screws 230 that passes through the modules faceplate 235. Similar to the plug-in module, open and closed garage door status visual indicator LEDs 215 & 220 and the door closing switch 225 are provided on the face plate of the module. Also, the hardwired remote includes a housing 205 containing the power supply, transceiver and controller. Unlike the plug in module, the hardwired module includes at least two wires 240 or a terminal block (not shown) for connecting the module into the power grid of the associated building.

Two optional accessory modules are illustrated in FIGS. 4 & 5. These two modules are commonly available standard X-10 modules utilized in home automation applications. The plug-in module of FIG. 4 comprises a housing 305, a plug 310 extending from the backside of the housing for interfacing with a common household receptacle, a receptacle 315 for receiving the lamp or other device to be turned off and on by the module, and a coupe of rotary switches 320 to set the signal codes for the module. A screw in module for receipt into a standard light fixture is illustrated in FIG. 5. This module comprises a housing 325, a threaded male section 330 to be screwed into the light fixture and a corresponding threaded female section 335 to receive a standard light bulb therein. The signal codes for this module are set by sending the desired codes to the module in a particular sequence wherein the module is configured to turn off or on based on those codes thereafter. Either module can be configured to automatically turn on associated lights when triggered by the garage module such as when a garage door is initially opened. Furthermore, the garage module can be configured to send out an "off" signal to turn off the lights attached to the modules after a preset period of time has passed. There is no limit to the number of modules that can be utilized in a particular building. A user might have a single module to turn on a single lamp or he/she can have many modules to effectively light up the entire house.

As mentioned above, the various modules of the first preferred embodiment transmit and/or receive various signals over the power grid of an associated building using the X-10 protocol. Other protocols for signal transmission can be utilized or proprietary protocols can be developed to accomplish the same results. However, the use of the X-10 standard increases the potential versatility of the system permitting the user to utilize off the shelf X-10 components such as the previously described lamp modules.

Figure 6:
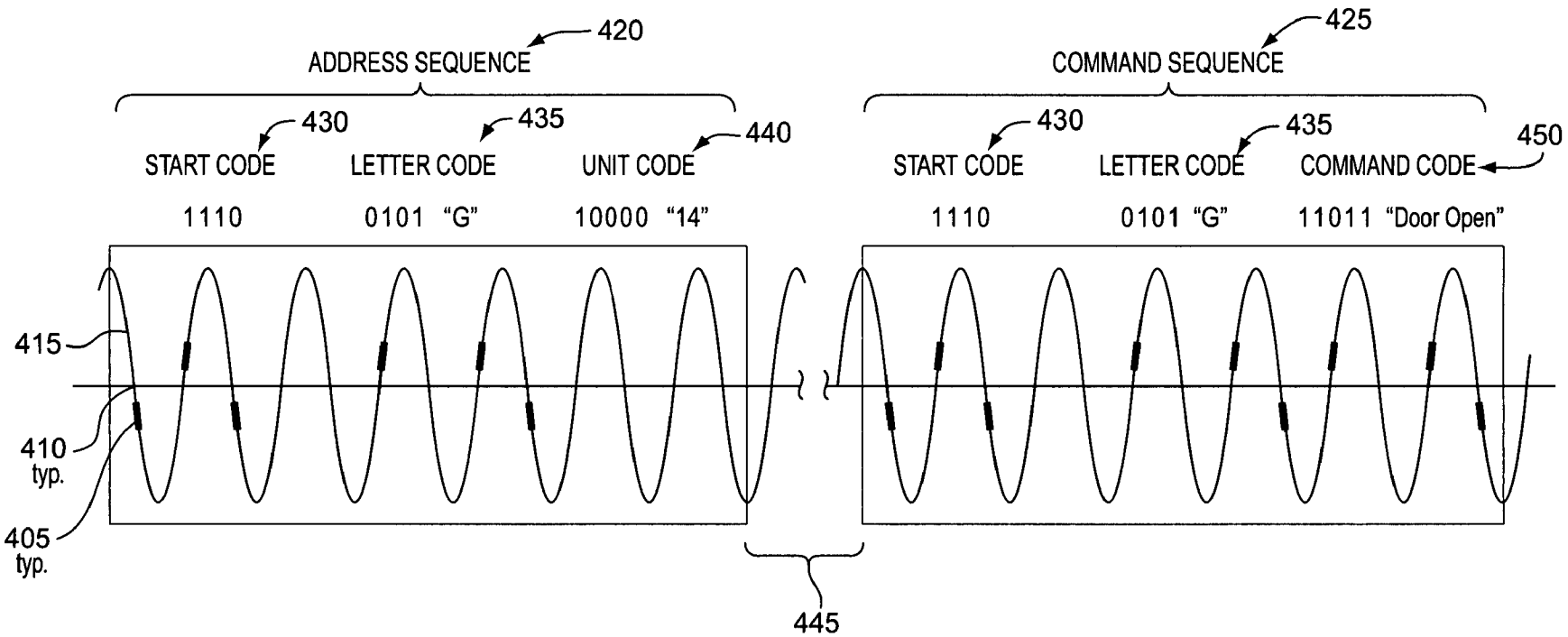
FIG. 6 is a graphical waveform illustration of AC current also showing pulse bit signals transmitted by the modules of one embodiment of the present invention.

Referring to FIG. 6, typical X-10 signals are transmitted as 1 ms voltage pulse bits 405 just after each zero crossing 410 of the associated buildings AC current signal 415. In North America, AC power is transmitted at 60 Hz with two zero crossings in each complete cycle resulting in 120 zero crossings per second. Information is transferred using binary code wherein the presence of a pulse comprises a "1" bit and the absence of a pulse comprises a "0" bit. The various sequences of binary bits are interpreted by the modules that either act based on the signals being broadcast by another module or ignore the signals if they do not pertain to the particular module.

FIG. 6 graphically illustrates a sequence of pulse bits that can be utilized by the garage module to notify the remote module that the garage door is open. The transmission comprises an address sequence 420 that alerts the target receiving modules and a command sequence 425 that instructs the receiving modules to carry out a particular action. A transmitting module first sends out a start signal 430 comprising three pluses and then no pulse on the fourth crossing representing the binary code "1110". The start code indicates to any X-10 module connected to the power grid that additional signals will be sent thereafter. Effectively, the start code acts to synchronize all the receivers of the various modules with the transmitter.

Next a "house code" 435 (or "letter code" is transmitted starting with the next zero crossing after the start code has been completed and comprises four crossings (or 4 bits) in total to indicate to the modules whether the ensuing signal is intended for them. For simplicity, the house codes are designated as the letters A–P. If the receiving module is not set to the indicated house code then it ignores the subsequent transmission of pulses as the signal is not intended for it. If the house code matches the house code to which the module is set, it awaits the next set of pulses from the receiver. Once the house code has been sent, all the appropriate remote and accessory modules of the system will be alerted to await the "Unit Code" 440. In the first preferred embodiment, the modules are also set to a house code of G. However, the modules can be reconfigured if necessary to utilize one of the other house codes. The need to reprogram the modules for a different house code may arise if the particular building in which the garage door monitoring and actuation system is being installed already has an X-10 automation system operating on the power grid that utilizes the "G" house code for other purposes.

The "unit code" 440 comprises five zero crossings wherein the last crossing is always a "0" that acts to designate the preceding pulses as being part of a "unit code". Accordingly, there are 16 different unit codes. Each unit code typically pertains to a particular module type. For instance, in the preferred embodiment the default unit codes are 14, 15 and 16. "14" is used to identify the one or more remote modules as the intended recipients of the signal. "15" is used to identify the one or more garage modules as the intended recipients, and "16" is used to identify the one or more accessory modules as the intended recipients. Of course, different unit codes can be utilized and the preferred embodiment does provide for the reconfiguring of the system, if necessary, to avoid conflict with other X-10 devices and modules. Pertaining to FIG. 6, the unit code pertains to the number "14", which means the accessory module can ignore the following "command codes". Once the unit code has been received, the transmitter (the garage module in this example) retransmits the start code, house code and unit code sequence for purposes of redundancy and reliability.

Next, a command sequence is sent twice over the power grid for the appropriate modules identified in the proceeding address sequence to receive the sequence and act upon it. The command sequence is transmitted after 6 zero crossings 445 of silence and comprises the same start code 430 described above, the letter code 435 associated with the particular modules identified during the address sequence, and a 5-bit command code 450. The command code always ends in a "1" bit to differentiate it from a unit code. There are 16 different command codes but only a few commands are typically utilized in the present invention. The "door open" command comprises the binary sequence "11011" and is utilized in the present example by the garage module to signal the remote module that the garage door is open.

As indicated above the first preferred embodiment of the invention uses house code "G" and unit codes 14, 15 and 16 to refer to the remote, the garage, and the accessory modules respectively. In certain instances, such as when an associated residence is already using an X-10 automation system or when a neighboring system is interfering with the user's system, the user may need to reprogram one or both of the house code 435 and the unit codes 440. Accordingly, the preferred embodiment of the present invention is configured to permit a user to change both the house code and the unit codes of the garage module and the remote module from the remote module. In other words, the house and unit codes are remotely reprogrammed for the garage module from the remote module. The house or unit codes for any accessory modules are typically changed manually at each accessory module although in variations of the preferred embodiment, the accessory modules can also be configured for remote programming.

To change the house code 435, a user first plugs the remote and garage modules into the same power grid. Next, the user presses and holds the close button 225 for 10 seconds until the open door visual indicator 215 illuminates to indicate the remote module has been placed in its setup mode. Next, the user presses and releases the close button a number of times corresponding to the desired house code. For instance, if the user desires it to set the unit to a house code of D, the user would press and release the close button four times. The last press of the button is held for at least three seconds causing the new house code to be stored in the remote module.

Next, the close button 225 is pressed and released a number of times corresponding to the desired unit code 440 of the remote module. The last press is held for three seconds or more causing the new unit code to be stored in the remote module. The remote module will then indicate the new settings by flashing the open door visual indicator 215 the number of times corresponding to the new house code 435 and after a three second delay flashing the open door visual indicator the number of times corresponding to the new unit code. Simultaneously, using standard X-10 transmission protocols the remote module will transmit the new house code and a new unit code for the garage module to the garage module. Note that the unit code for the garage module will be one greater than the unit code for the remote module (i.e. if the remote module unit code is 10, the unit code of the garage module will be 11). After the transmission of the new codes to the garage module is complete and if the garage module is equipped with laser pointers 115 then the laser pointers will flash the garage module's new house and unit code. Of course, other methods of reprogramming the house and unit codes may be utilized in variations of the preferred embodiment and alternative embodiments.

A block diagram indicating how the various components interface is illustrated in FIG. 7. One garage module 505, one remote module 510 and one optional accessory module 515 are illustrated and are all coupled to receive and/or send signals via a power grid of an associated building. It is to be appreciated as described below in a later section tat more than one module of any type can be utilized in a particular system.

The power grid 520 serves two functions for each of the modules: (1) it provides power to the modules through an associated power supply 565, 570 & 575; and (2) serves as the conduit for signals transmitted and received by the transceivers 525 & 530 and received by the receiver 535 of the respective modules.

Each module further includes a controller 540, 545 & 550 that either causes (i) the associated module to perform an action based on a signal received by the module, or (ii) the transceiver to transmit a signal based on input from a switch (or sensor) associated with the particular module.

Concerning the garage module 505, the garage module is configured to receive a "close door" signal from the remote module 510. In response, the controller signals to the garage door to close the door. A garage door position sensor 555 is coupled with the module to indicate the relative position of the garage door. Typically, the garage door position sensor comprises a simple on/off two position magnetic switch that only indicates whether the door is fully closed or at least partially open. In variations of the preferred embodiments, the sensor can comprise any suitable sensor including, but not limited to, a beam sensor and a mechanical switch. When the associated garage door is opened moving the sensor into its "off" position, the garage module's controller reacts by causing the transmitter 525 to transmit the appropriate signal to the remote module 510. The controller may also cause the laser pointers 560 to activate and send another signal to the accessory module 515 to turn on a light attached to the accessory module. The garage module controller further includes a timer circuit that causes the controller to turn off the laser pointers after a certain period of time has past or to send a signal to the accessory module to switch off after another (or the same) period of time has passed.

Concerning the remote module 510, its controller 545 upon a receipt of a first signal that the garage door is open causes a signal indicator 590, such as an LED, to be activated indicating to a viewer that the garage door is open. The controller is also coupled with a user activated switch 585 or button that when activated send a signal to the garage module to close signal the garage door opener 580 to close the garage door.

Concerning the accessory module 515, its controller 550 responds to signals received by its receiver 535 (the accessory module does not have the capability to transmit signals). According to the signal received the controller causes an automatic switch 595 to turn on or off either activating or deactivating a lamp or other appliance coupled with the module typically through an outlet 597.

Operation of the Preferred Embodiment

Figure 8:
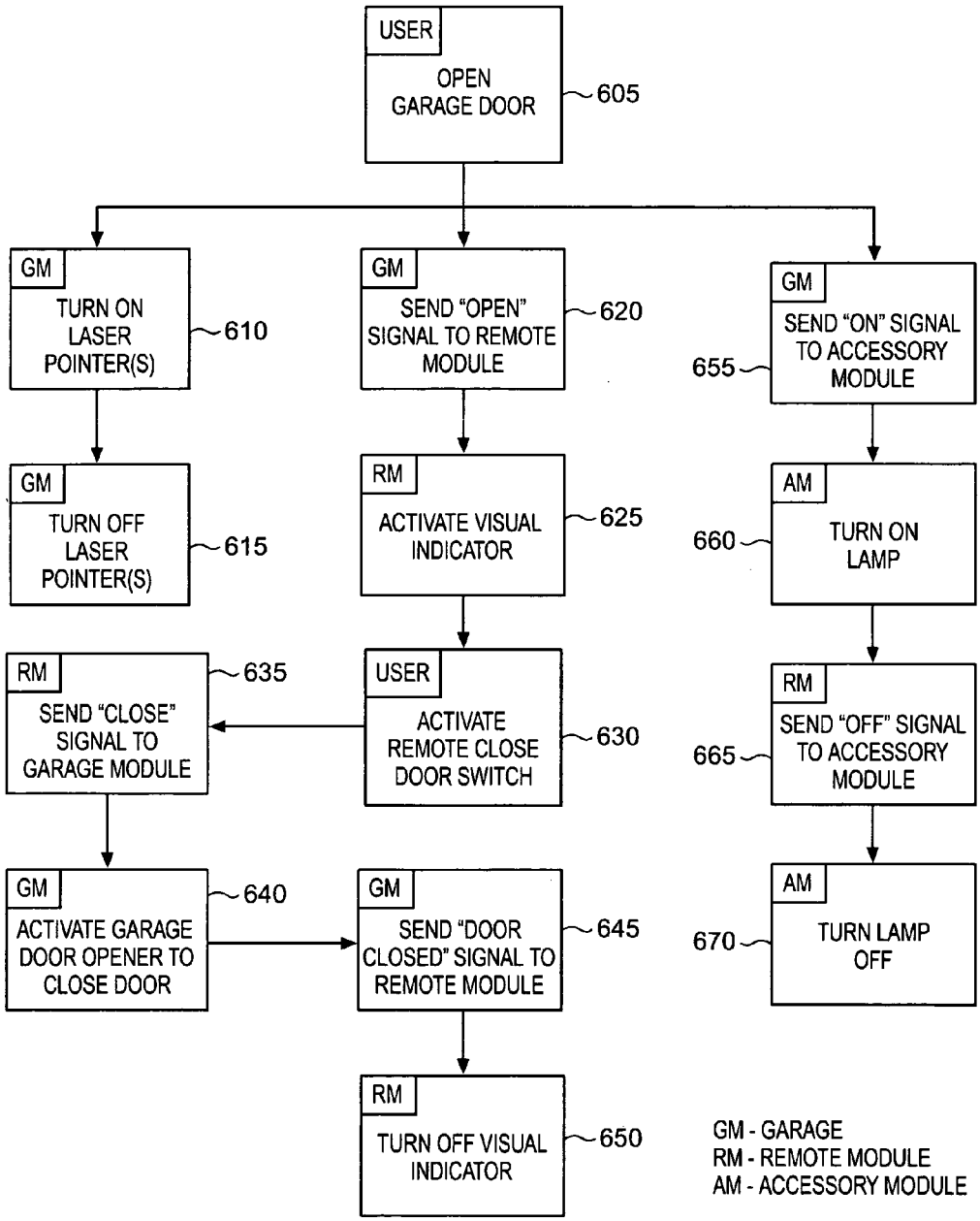
FIG. 8 is a flow chart illustrating the operation of one embodiment of the present invention.

FIG. 8 is a flow chart illustrating the operation of a typical garage door monitoring and actuation system according to the preferred embodiment.

Referring to block 605, a user opens the garage door in a typical manner such as activating the garage door opener from an in-vehicle remote. As the garage door opens, the garage door position sensor is moved from the closed position to the open position indicating to the garage module that the garage door is at least partially open. In response to the open garage door, the garage module turns on the one or two laser pointers attached to the module as indicated in block 610. As described above, the laser pointers are typically attached to the housing of the garage module via ball and socket or other flexible connections. The laser pointers can be pointed to a particular reference location in the garage. Typically, the laser pointers are aimed at a reference point on a vehicle that is normally parked in the associated garage. Accordingly, a user when parking can maneuver the vehicle to align the reference point on the vehicle with the laser to ensure the vehicle is properly positioned in the garage. As a predetermined period of time has passed, such as 2 minutes, the laser pointer(s) will be automatically turned off by the garage module as indicated in block 615.

Also in response to the opening of the garage door, the garage module will send an "open" signal to the remote module as indicated in block 620. In response to this signal as shown in block 625, the remote module will activate its visual indicator to alert any person who looks at the remote module that the garage door is open. The indicator, which typically comprises an LED in the preferred embodiments of the invention, will remain activated until the remote module has received a signal from the garage module indicating that the garage door has been closed. A variation of the preferred remote module embodiment may also include an audio alert signal which is momentarily activated whenever the "open signal" is received.

A user, who notices the visual or audio indicator is active, can attempt to close the garage door from location of the remote module by activating a close door switch or button on the remote module as indicated in block 630. In one preferred embodiment of the system, the visual indicator is an LED that flashes when the garage door switch has been activated and presumably the garage door is being closed. In response to the activation of the close door switch, the remote module sends a "close door" signal to the garage module as indicated in block 635 that causes the garage module upon receipt of the signal to trigger the garage door opener to activate and close the garage door as indicated in block 640. In one preferred embodiment, if the garage position sensor does not indicate the garage door has closed after 20 seconds the garage module will attempt to close the garage door a second time. If after two attempts the garage door has not closed, the garage module will send an open signal to the remote module so that the remote module will reactivate the visual indicator to alert a user that the garage door would not close.

In preferred embodiments, the garage module is only capable of triggering the garage door opener to close the garage door. Accordingly, a user will not inadvertently be able to unknowingly and accidentally open the garage door with the remote module. It is to be appreciated, however, that in certain alternative embodiments that the ability to open a garage door from a remote can be incorporated into the system.

Referring to block 645, the garage door module sends a "door closed" signal to the remote module after the garage door has closed, which causes the remote module to turn off its "open" visual indicator as indicated in block 640. If the remote module has a "closed" visual indicator, it is activated as well. If the garage door is not successfully closed, as might be the case when an object or other obstruction prevents the garage door opener from fully closing the garage door, the open visual indicator will continue to be activated. Further, with the one preferred embodiment incorporating a flashing LED during the closing operation, the LED will continue to flash if a "door closed" signal is not received thereby indicating to the user that he/she should considering investigating the reason why the door has not closed.

Referring to block 655, the garage module will also send an "on" signal to an accessory module immediately after the associated garage door is opened. The signal is received by the optional accessory module, which as indicated in block 660 switches on typically to illuminate a lamp that is plugged into the module (or to turn on a light bulb screwed into an associated socket if the module is of the type illustrated in FIG. 5). It is appreciated that other appliances or electrically powered devices can be plugged into the accessory module to be automatically turned on when the garage door is opened; however, it is contemplated that a lamp would be the most likely item to be plugged into the accessory module to provide light in the building associated with the garage. Variations of the accessory module can also incorporate a photo sensor that measures the amount of light in the room in which it is resident. Accordingly, the accessory module can be configured not to switch the power on upon receipt of the "on" signal from the garage module when the room is not dark. After a suitable period of time has past, such as enough time for the user to enter the home and turn on other lights or travel to the desired part of the building, the garage module sends an "off" signal to the accessory module to switch the power supply to the lamp (or other AC-powered appliance) off as indicated in blocks 665

& 670. In one preferred embodiment, the time period in which the accessory module is switched on is about four minutes.

The preferred embodiment may also be used to interface with intelligent X-10 automation controllers to allow garage door closure associated with events such as the time of day or the arming of a security system. This arrangement could also be used to trigger other complex external events based on the opening or closing of the garage door.

Variations of the Preferred Embodiment

Numerous variations of the described preferred embodiment are contemplated. For instance, although the system is described with reference to single garage, remote and accessory modules, multiple modules of any type can be utilized in any suitable configuration. For instance, two, three or more garage modules each connected to separate garage door opener relating to different bays in a multi-car garage can be used in the same system. Operationally, if anyone of the associated garage doors is open the particular garage module will send out an "open" signal to the remote modules. The "open" signals transmitted by any of the modules are identical and anyone will cause the door open visual indicator to be activated. Likewise when a door "close" signal is sent from any remote module, all the garage modules associated with an open door will activate the associated garage door openers to close the associated garage door.

Also any number of remote modules can be used with the system. Accordingly, a user can place a remote module in any room he/she desires. Any door "open" signal sent by any garage module will cause the "door open" visual indicators of all the remote modules to activate. Likewise, a "close" signal from anyone of the remote modules will cause the garage module to activate the garage door opener. Finally, the "closed" from the garage module will cause all the remote modules to deactivate its "door open" visual indicator.

Finally, any number of accessory modules can be utilized with the system. A user could have modules in different rooms of the house to light all or a significant portion of the house when the garage door is opened. All the accessory modules will switch on or off when a respective "on" or "off" signal is sent by the garage module. As can be appreciated, other variations of the system can include more than one module of each type, such that more than one garage module is utilized in conjunction with more than one remote module and more than one accessory module. An intelligent X-10 automation controller may also be utilized with the system to allow complex events to be associated with the opening or closing of the garage door(s).

Alternative Embodiments

The embodiments of the garage door monitoring and actuating system as illustrated in the accompanying Figures and described above are merely exemplary and are not meant to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

While a particular signal transmission protocol has been described, other transmission protocols can be utilized instead as would be obvious to one of ordinary skill in the art. Further, different types of signals can be utilized other than those specifically described to accomplish similar results as the system described in detail herein. For instance, in a multiple garage module system, each module can have its unique signals such that a remote module can differentiate between the different garage modules. The remote module could also have separate visual indicators for each of the different garage modules. In another example, the garage module can periodically send a status signal to the remote module as to its current status (i.e. the garage door is open or closed) instead of sending signals only when (or within a predetermined period of time after) the garage door is either opened or closed. Likewise, the garage module can be programmed to differentiate between different accessory modules such that they are turned off after different respective periods of time as desired by the user. Further, in yet other embodiments the accessory modules may incorporate their own timer circuits, to turn off automatically after being turned on with having to receive an "off" signal from the garage module.

While the preferred embodiments utilize signals transmitted over the power grid of a house or building, in alternative embodiments any suitable transmission means can be utilized including, but not limited to, wireless transmission and dedicated hard wiring. The modules may also vary significantly from those illustrated herein. For instance, in some variations the laser pointers can be omitted. In other variations, the garage module and its functionality can be integrated with a garage door opener. When integrated with a garage door opener, the garage door position sensor can be eliminated as the integrated device can utilize the garage door sensor of the opener instead. In yet other embodiments, a central controller can be provided to process all the signals and set up the operational protocols of the various modules. The central controller can comprise a personal computer with an appropriate interface. Accordingly, a user can determine and set the operational characteristics of the device (such as the various address and command codes, as well as, operational periods of time from a central location.

We claim:

1. A garage door status monitoring and actuating system comprising:

a first garage module adapted to be coupled to a first garage door opener and to actuate the first garage door opener, the garage module including a first transceiver;

a first garage door position sensor adapted for being coupled with the first garage module;

a first remote module adapted to be located remotely from the first garage module within a building, the first remote module including a second transceiver, a first indicator, and a first switch; and wherein (i) the first transceiver is adapted to send a first signal to the second transceiver when the garage door position sensor is in a first state, (ii) the first remote module is adapted to activate the first indicator upon receipt of the first signal, (iii) the second transceiver is adapted to send a second signal when the first switch is activated, and (iv) the first garage module is adapted to actuate the garage door opener upon receipt of the second signal.

2. The garage door status monitoring and actuating system of claim 1, wherein the first and second transceivers are adapted to transmit the first and second signals over the power grid of the building.

3. The garage door status monitoring and actuating system of claim 2, wherein the signals comply with X-10 standards.

4. The garage door status monitoring and actuating system of claim 1, further comprising (1) a second garage module, the second garage module including a third transceiver and being adapted to be coupled to a second garage door, and (2) a second garage door position sensor adapted for being coupled with the second garage module, wherein (i) the third transceiver is adapted to send the first signal to the second transceiver when the second garage door position sensor is in a first position, (ii) the second garage module is adapted to actuate the second garage door opener upon receipt of the second signal.

5. The garage door status monitoring and actuating system of claim 1, wherein the first garage module is only adapted to actuate the first garage door opener to close an associated garage door.

6. The garage door status monitoring and actuating system of claim 4, wherein the first and second garage modules are only adapted to actuate respective first and second garage door openers to close associated garage doors.

7. The garage door status monitoring and actuating system of claim 1, further comprising a second remote module including a third transceiver, the second remote module being adapted to be located remotely from the first garage module within the building, the second remote module including a second indicator and a second switch, wherein the (i) the second remote module is adapted to activate the second indicator upon receipt of the first signal, and (ii) the third transceiver is adapted to send the second signal when the second switch is activated.

8. The garage door status monitoring and actuating system of claim 1, wherein the first garage module further comprises at least one laser-pointing device, wherein the first garage module is adapted to activate the laser pointing device for a period of time following the change of the first garage door position sensor from a second state to a first state.

9. The garage door status monitoring and actuating system of claim 1, wherein the first garage door position sensor comprises a magnetic sensor switch and associated magnetic sensor.

10. The garage door status monitoring and actuating system of claim 1, further comprising an accessory module, the accessory module including a receiver, an automatic switch and an electrical outlet, wherein (i) the accessory module is adapted to actuate the automatic switch upon receipt of the first signal.

11. The garage door status monitoring and actuating system of claim 10, wherein the first transceiver is further adapted to send a third signal generally contemporaneously with the first signal, and wherein the accessory module is adapted to actuate the automatic switch upon receipt of the third signal.

12. A garage door status monitoring and actuating system comprising:

a garage module electrically coupled with a garage door opener and an AC power grid of an associated building, the garage module including a first transceiver adapted to transmit at least a first signal over the power grid and receive a second signal over the power grid;

a garage door position sensor mounted proximate a garage door, the garage door position sensor being coupled with the garage door module, the garage door position sensor having at least two states, a first state when the garage door is at least partially open and a second state when the garage door is completely closed;

a remote module electrically coupled with the AC power grid of the associated building, the remote module including (i) a second transceiver adapted to transmit at least the second signal over the power grid and receive the first signal, (ii) a user actuatable switch, and (iii) a visual indicator; and wherein (a) the first signal is transmitted by the garage module when the garage position sensor moves into the first state, (b) the remote module upon receiving the first signal activates the visual indicator to indicate the garage door is open, (c) the remote module transmits the second signal when the switch is depressed, and (d) the garage module upon receiving the second signal activates the garage door opener to close the garage door.

13. The garage door status monitoring and actuating system of claim 12, further comprising an accessory module, the accessory module including a receiver, an automatic switch, and an electrical outlet, the accessory module being connected to the AC power grid and having a lamp plugged into the electrical outlet, wherein (i) the accessory module is adapted to actuate the automatic switch upon receipt of the third signal from the garage module and turn on the lamp.

14. The garage door status monitoring and actuating system of claim 12, wherein the garage module further comprises one or more laser pointers and a timed switch, wherein the timed switch activates the one or more laser pointers when the first garage door position sensor changes from a second state to a first state, and the timed switch deactivates the one or more laser pointers after a predetermined span of time has passed.

15. The garage door status monitoring and actuating system of claim 12, further comprising a second garage module and a second garage door position sensor, the second garage door module electrically coupled to a second garage door opener and including a third transceiver adapted to transmit at least the first signal over the power grid and receive the second signal over the power grid, the second position sensor mounted proximate a second garage door, the second garage door position sensor being coupled with the second garage door module, the second garage door position sensor having at least two states, a first state when the garage door is at least partially open and a second state when the garage door is completely closed.

16. The garage door status monitoring and actuating system of claim 12, further comprising a second remote module, the second remote module including (i) a third transceiver adapted to transmit at least the second signal over the power grid and receive the first signal, (ii) a second user actuatable switch, and (iii) a second visual indicator, wherein (a) the second remote module upon receiving the first signal activates the second visual indicator to indicate the garage door is open, and (b) the second remote module transmits the second signal when the switch is depressed.

17. The garage door status monitoring and actuating system of claim 12, wherein the garage module is adapted only to activate the garage door opener to close the garage door and not to open the garage door.

18. A method of operating a garage door status monitoring and actuating system, the method comprising in the provided order:

sending a first signal over an associated building's power grid from a garage module to a remote module;

activating a visual indicator at the remote module indicating an associated garage door is open;

sending a second signal over the associated building's power grid from the remote module to the garage module upon activating a switch on the remote module by the user; and activating the garage door opener to close the garage door after receiving the second signal.

19. The method of claim 18, further comprising sending a third signal, and after the third signal is sent, turning on a lamp by activating an automatic switch in an accessory module.

20. The method of claim 18, further comprising activating one or more laser pointers of the garage module generally contemporaneously with said sending the first signal.

* * * * *